US009707769B2

(12) United States Patent
Suzuki et al.

(10) Patent No.: US 9,707,769 B2
(45) Date of Patent: Jul. 18, 2017

(54) RECORDING APPARATUS

(71) Applicant: SEIKO EPSON CORPORATION, Tokyo (JP)

(72) Inventors: Hidenao Suzuki, Matsumoto (JP); Shoichi Ishizawa, Asahi-mura (JP); Yoshiyuki Tanaka, Matsumoto (JP); Makoto Omuro, Matsumoto (JP); Koji Kawai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/226,432

(22) Filed: Aug. 2, 2016

(65) Prior Publication Data

US 2017/0057235 A1 Mar. 2, 2017

(30) Foreign Application Priority Data

Aug. 26, 2015 (JP) ..... 2015-166987

(51) Int. Cl.
*B41J 2/175* (2006.01)

(52) U.S. Cl.
CPC ..... *B41J 2/1752* (2013.01)

(58) Field of Classification Search
CPC .. B41J 2/1752; B41J 2/17506; B41J 2/17509; B41J 2/17523; B41J 2/17533; B41J 2/17536; B41J 2/1754
See application file for complete search history.

(56) References Cited

U.S. PATENT DOCUMENTS

| | | | | |
|---|---|---|---|---|
| 4,914,453 | A | 4/1990 | Kanayama et al. | |
| 2008/0297571 | A1* | 12/2008 | Umeda | B41J 2/17509 347/85 |
| 2012/0038719 | A1 | 2/2012 | Shimizu et al. | |

FOREIGN PATENT DOCUMENTS

| | | | |
|---|---|---|---|
| CN | 101786379 | B | 1/2012 |
| JP | H01-158132 | U | 11/1989 |
| JP | 2008-296508 | A | 12/2008 |
| JP | 2012-020495 | A | 2/2012 |

* cited by examiner

*Primary Examiner* — Juanita D Jackson
(74) *Attorney, Agent, or Firm* — Workman Nydegger

(57) ABSTRACT

A recording apparatus includes a recording head configured to discharge an ink onto paper for recording, a case accommodating at least the recording head, a reading device openable and closable between an open position and a closed position, a liquid container having a liquid storage chamber for storing the ink to be supplied to the recording head and an injection port enabling the ink to be injected from the outside to the inside of the liquid storage chamber, a blocking member configured to block the injection port by coming into contact with the injection port, and a cover provided such that the cover can be opened or closed between an open position where the injection port is exposed and a closed position where the injection port is not exposed. The blocking member is mounted on the cover.

15 Claims, 12 Drawing Sheets

RECORDING APPARATUS

BACKGROUND

1. Technical Field

The present invention relates to a recording apparatus, for example, an ink jet type printer.

2. Related Art

In the related art, there are known ink jet printers (recording apparatuses) equipped with a recording head that discharges ink, which is an example of a liquid, onto paper, which is an example medium, for recording. Among these printers, some printers include ink tanks (liquid containers) that store inks to be supplied to a recording head. For example, JP-A-2012-20495 describes a printer that includes an ink tank into which an ink can be injected through a liquid injection port provided on the ink tank.

The ink tank provided in the printer described in JP-A-2012-20495 has a plug member (blocking member) that blocks the liquid injection port to reduce leakage of the ink stored in the ink tank from the liquid injection port. In another generally known printer, an openable cover that covers a liquid injection port on which a plug member for blocking the liquid injection port is mounted so as to reduce the risk of dropping-off of the plug member due to the increase in internal pressure in the ink tank, an impact from the outside, or the like. In such a structure including the cover for covering the liquid injection port in addition to the plug member for blocking the liquid injection port, however, it is laborious to inject the ink because the cover has to be opened and then the plug member has to be removed from the liquid injection port to inject the ink into the ink tank.

SUMMARY

An advantage of some aspects of the invention is that there is provided a recording apparatus that enables a user to inject a liquid into a liquid container without being laborious and also a blocking member for blocking an injection port provided to the liquid container for storing the liquid and a cover that covers the injection port.

Hereinafter, apparatuses for solving the aforementioned problem and their working effects will be described. A recording apparatus for solving the aforementioned problem includes a recording head configured to discharge a liquid onto a medium for recording, a casing accommodating at least the recording head, an opening and closing member openable and closable between an open position where the inside of the casing is exposed and a closed position where the inside of the casing is not exposed, at least one liquid container having a liquid storage chamber for storing the liquid to be supplied to the recording head and an injection port enabling the liquid to be injected from the outside to the inside of the liquid storage chamber, at least one blocking member configured to block the injection port by coming into contact with the injection port, and a cover provided such that the cover can be opened or closed between an open position where the injection port is exposed and a closed position where the injection port is not exposed. The number of the liquid containers is two or more and the number of the blocking members corresponds to the number of the injection ports in the liquid containers, and the blocking members are mounted on the cover.

With this structure, the contact operation and the separation operation of the blocking members for blocking the injection ports to the injection ports are performed in conjunction with the opening and closing operations of the cover that covers the injection ports of the liquid containers. That is, the blocking members can be separated from the injection ports when a user opens the cover, and consequently, the user is able to inject the liquids into the liquid storage chambers by only opening the cover. Consequently, the liquids can be injected into the liquid containers without being laborious while the blocking members for blocking the injection ports provided on the liquid containers that store the liquids and the cover that covers the injection ports are provided. The plurality of blocking members that block the plurality of injection ports respectively can be separated from the injection ports in a single operation by opening the cover. Consequently, the time and labor for injecting the liquids into the plurality of liquid containers can be reduced.

A recording apparatus for solving the aforementioned problem includes a recording head configured to discharge a liquid onto a medium for recording, a casing accommodating at least the recording head, an opening and closing member openable and closable between an open position where the inside of the casing is exposed and a closed position where the inside of the casing is not exposed, at least one liquid container having a liquid storage chamber for storing the liquid to be supplied to the recording head and an injection port enabling the liquid to be injected from the outside to the inside of the liquid storage chamber, a blocking member configured to block the injection port by coming into contact with the injection port, and a cover provided such that the cover can be opened or closed between an open position where the injection port is exposed and a closed position where the injection port is not exposed. The number of liquid containers is two or more, and the blocking member is mounted on the cover to block the plurality of injection ports in the plurality of liquid containers.

With this structure, the contact operation and the separation operation of the blocking member for blocking the injection ports to the injection ports are performed in conjunction with the opening and closing operations of the cover that covers the injection ports of the liquid containers. That is, the blocking member can be separated from the injection ports when a user opens the cover, and consequently, the user is able to inject the liquids into the liquid storage chambers by only opening the cover. Consequently, the liquids can be injected into the liquid containers without being laborious while the blocking member for blocking the injection ports provided on the liquid containers that store the liquids and the cover that covers the injection ports are provided. The one blocking member that blocks the plurality of injection ports can be separated from the injection ports in a single operation by opening the cover. Consequently, the time and labor for injecting the liquids into the plurality of liquid containers can be reduced.

In the above-described recording apparatus, it is preferable that the blocking members are detachably mounted to the cover.

With this structure, the blocking member can be replaced as needed, for example, if the blocking member has deteriorated.

In the above-described recording apparatus, it is preferable that the blocking member be larger than the injection port and that the blocking member be composed of an elastically deformable elastic member.

With this structure, the blocking member is larger than the injection port of the liquid container, and the blocking member is capable of coming into contact in an elastically deformable manner with the injection port of the liquid container. Consequently, the sealing capability of the blocking member can be increased and the injection port can be appropriately blocked.

In the above-described recording apparatus, it is preferable that the casing further accommodate at least a portion of the liquid containers and that the cover be rotatably provided with respect to the casing. With this structure, the cover can be more readily opened or closed compared with, for example, a structure in which a cover is opened or closed by sliding the cover.

In the above-described recording apparatus, it is preferable that an engaging portion be provided in one of the cover and the casing and that a portion to be engaged, which can be engaged with the engaging portion, be provided in the other one, and that the engaging portion engage the portion to be engaged when the cover is positioned in the closed position.

With this structure, the risk of the cover readily opening in response to an impact or vibrations can be reduced by the engagement of the engaging portion with the portion to be engaged. In the above-described recording apparatus, it is preferable that the casing have a discharge port from which the medium on which recording has been performed with the recording head in the casing is to be discharged to the outside of the casing and that the liquid containers be disposed at a location corresponding to a side at which the discharge port is provided in the casing and a corner in the casing.

With this structure, the space in the casing can be efficiently used and the liquid can be readily injected into the liquid container disposed in the casing.

In the above-described recording apparatus, it is preferable that the casing include an operation section to be used to operate the recording apparatus and that the liquid containers be disposed at a location corresponding to the side at which the operation section is provided in the casing and a corner in the casing.

With this structure, the space in the casing can be efficiently used and the liquid can be readily injected into the liquid container disposed in the casing.

In the above-described recording apparatus, it is preferable that the casing include a viewing section through which the amounts of the liquids stored in the liquid storage chambers in the liquid containers can be viewed.

With this structure, the amounts of the liquids remaining in the liquid storage chambers can be checked through the viewing section, and the liquids can be injected into the liquid containers at an appropriate time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
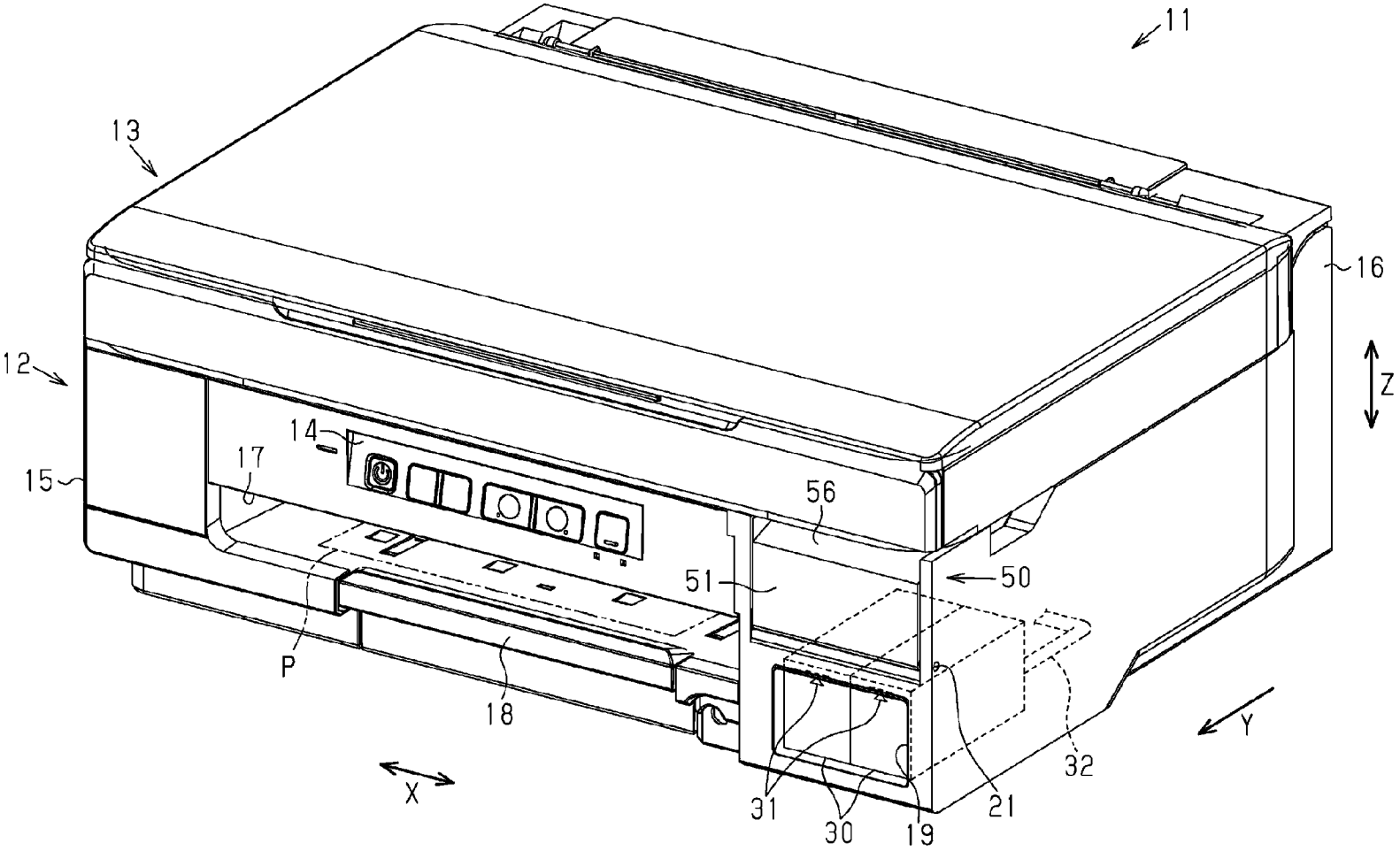
FIG. 1 is a perspective view of a multifunction peripheral according to a first embodiment.

Hereinafter, a multifunction peripheral that includes an ink jet type printer, which is an example of a recording apparatus, will be described with reference to the drawings. As shown in FIG. 1, a multifunction peripheral 11 includes a recording device 12 that performs recording onto paper P, which is an example medium, and a reading device 13 that reads an image. The recording device 12 includes a rectangular parallelepiped case (casing) 15 that is provided, on a surface, with an operation section 14 for users to operate the multifunction peripheral 11. A reading device 13 is disposed on the case 15 in the vertical Z direction. A hinge section 16 is provided on the back surface side of the multifunction peripheral 11 that is opposite to the front surface side on which the operation section 14 is provided in the multifunction peripheral 11. The recording device 12 and the reading device 13 are connected with each other by the hinge section 16. The operation section 14 includes, for example, a power button, an operation button, and the like to cause the multifunction peripheral 11 to perform various operations such as a recording operation with the recording device 12, a reading operation with the reading device 13, and the like.

A discharge port 17 is provided on the front surface of the case 15 where the operation section 14 is provided, and below the operation section 14. From the discharge port 17, the paper P on which recording has been performed by the recording device 12, is discharged. A discharge tray 18 that can be pulled toward the front of the recording device 12 is provided under the discharge port 17. A feed port (not shown) that is used to feed the paper P into the case 15 is provided on the back surface of the case 15. The paper P fed from the feed port into the case 15 is subjected to recording in the case 15, discharged from the discharge port 17, and placed onto the discharge tray 18. That is, the direction from the back surface toward the front surface of the recording device 12 is a transport Y direction of the paper P.

A viewing section 19 is provided on the front surface of the case 15 at a position (right side in FIG. 1) adjacent to the discharge port 17 such that a portion of the inside of the case 15 can be viewed by making a portion of the exterior of the case 15 from a transparent material, for example, glass or plastic. Liquid containers 30 that store ink, which is an example of a liquid, are provided at positions users can view from the outside through the viewing section 19, that is, positions within the case 15 and close to the front surface and an end portion (right end in FIG. 1) of the recording device 12. The plurality of liquid containers 30 (in this embodiment, two liquid containers 30) are arranged adjacently such that the long sides are in contact with each other in the lengthwise direction (lateral direction in FIG. 1) of the recording device 12. That is, the liquid containers 30 are accommodated in the case 15. Specifically, in the case 15, the liquid containers 30 are disposed on the front surface side of the case 15 where the operation section 14 and the discharge port 17 are provided, and at a corner of the rectangular parallelepiped case 15.

The liquid container 30 has a box shape and is used as a so-called ink tank that stores an ink to be used by the recording device 12 for recording to the paper P. The liquid container 30 is composed of a transparent or translucent resin through which the amount of the remaining stored ink can be viewed. An upper limit value 31 that indicates an upper limit value of the ink that the liquid container 30 can contain is marked on the front surface of the liquid container 30 that is opposite the viewing section 19 in the case 15. In the multifunction peripheral 11, the upper limit value 31 can be viewed from the outside of the case 15 through the viewing section 19.

Figure 2:
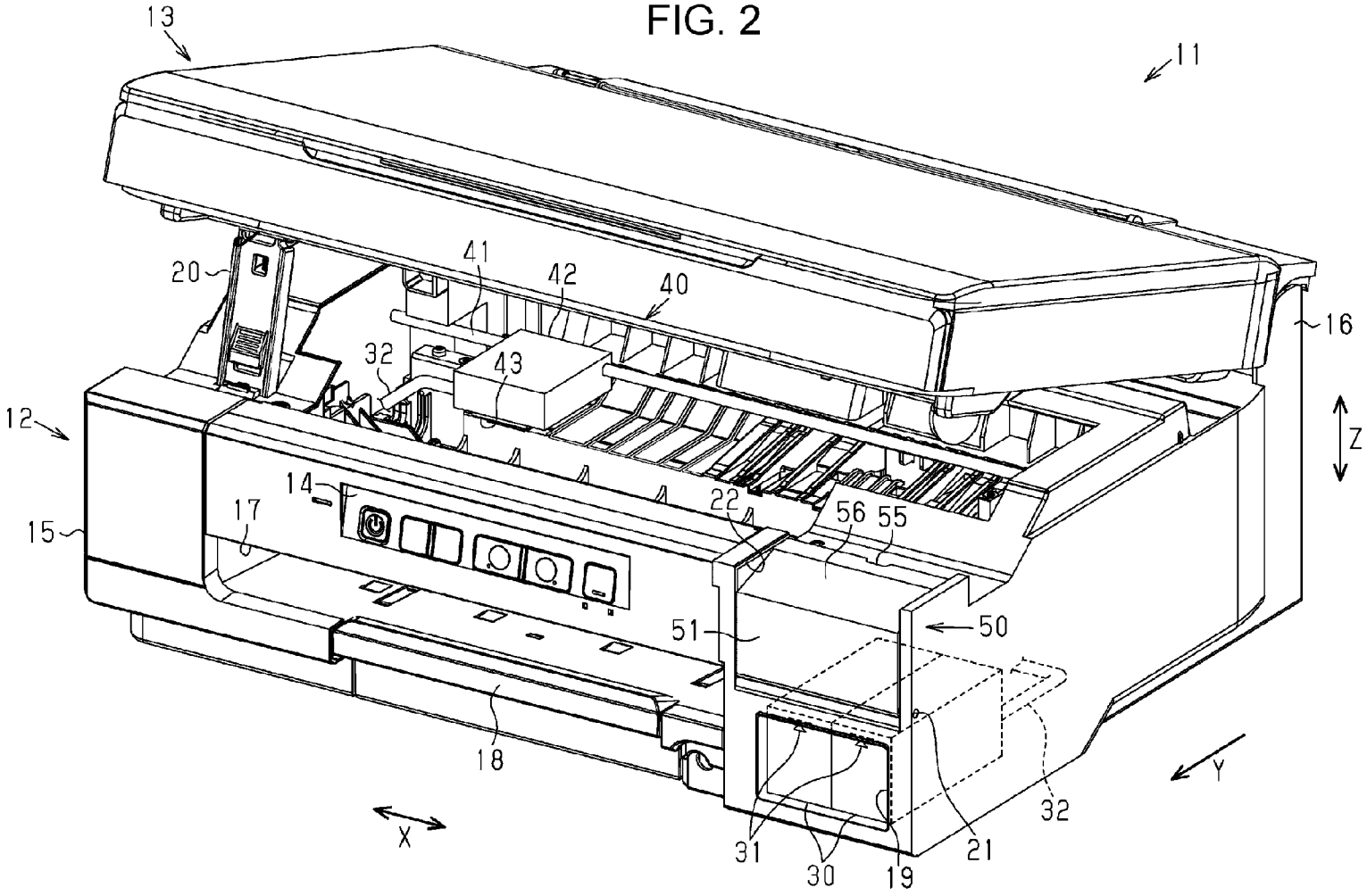
FIG. 2 is a perspective view of the multifunction peripheral in which a reading device is positioned at an open position.

As shown in FIG. 2, the reading device 13 can be rotated around the hinge section 16 with respect to the recording device 12 and can be opened or closed between two positions; an open position where the inside (i.e., the inside of the recording device 12) of the case 15 is exposed and a closed position where the inside of the case 15 is not exposed. In other words, the reading device 13 functions as an opening and closing member that is opened or closed with respect to the case 15. A link section 20 that supports the reading device 13 with respect to the recording device 12 is provided between the recording device 12 and the reading device 13 at a position close to an end portion (left side in FIG. 1) of the side opposite to the side where the liquid containers 30 are disposed in the lengthwise direction of the multifunction peripheral 11 and on the front surface side of the multifunction peripheral 11. The link section 20 holds the reading device 13 that is at the open position in an orientation inclined toward the recording device 12. In the multifunction peripheral 11 according to the embodiment, the link section 20 is linked to the reading device 13 such that the link section 20 rises as the reading device 13 is lifted.

A recording section 40 that performs recording toward the paper P is provided in the case 15. The recording section 40 includes a carriage 42 that is provided such that the carriage 42 can reciprocate along a guide shaft 41 that extends in scanning X direction intersecting the transport Y direction of the paper P, and a recording head 43 that is mounted on a lower surface of the carriage 42, the recording head 43 discharging ink onto the paper P that faces the carriage 42. That is, the recording device 12 performs recording of characters, images, and the like onto the transported paper P by moving the carriage 42 in the scanning directions X and discharging the ink with the recording head 43. The scanning X direction that intersects the transport Y direction corresponds to the lengthwise direction of the multifunction peripheral 11.

A supply tube 32 in which an ink flows is connected to the recording section 40. While one end of the supply tube 32 that extends into the case 15 is connected to the recording section 40, the other end is connected to the liquid container 30. That is, the recording section 40 and the liquid container 30 are connected via the supply tube 32, and through the supply tube 32, the ink stored in the liquid container 30 is supplied to the recording section 40. Each supply tube 32 is connected to each corresponding liquid container 30, however, for the sake of simplicity, only one supply tube 32 is shown.

Figure 3:
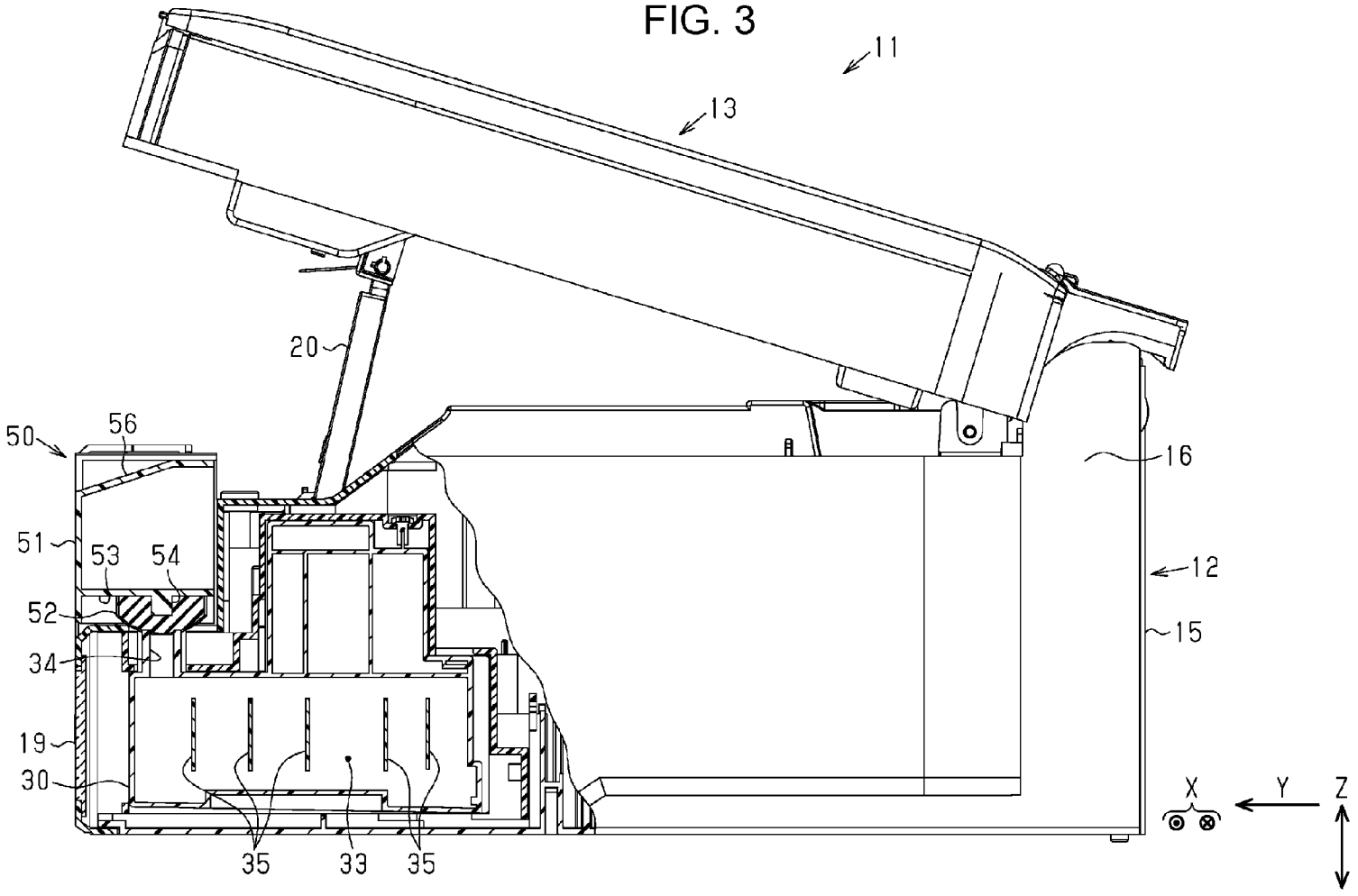
FIG. 3 is a partial cutaway side view of the multifunction peripheral in which the reading device is positioned at the open position.

As shown in FIG. 2 and FIG. 3, the liquid container 30 disposed in the case 15 includes a liquid storage chamber 33 that stores an ink, and an injection port 34 that extends upward from the liquid storage chamber 33 in the vertical Z direction. The injection port 34 opens on an upper part of the liquid container 30 and communicates with the outside and inside (i.e., the liquid storage chamber 33) of the liquid container 30. That is, the liquid container 30 is configured such that an ink can be injected into the liquid storage chamber 33 via the injection port 34. The liquid container 30 is provided at a position where the injection port 34 can be exposed from the case 15 of the recording device 12. A plurality of plate-like rib members 35 are provided in the liquid storage chamber 33. The ink stored in the liquid storage chamber 33 is supplied to the recording section 40 via the supply tube 32 by flowing along the rib members 35, and thereby, the ink is agitated and ink stagnation in the liquid storage chamber 33 can be reduced.

A cover 50 that covers the injection ports 34 from above is provided at a position above the liquid containers 30 and opposite the injection ports 34. A top view of the recording device 12 illustrates that the cover 50 can be opened or closed at two positions; an open position (see FIG. 10) where the injection ports 34 of the liquid containers 30 are exposed and a closed position (see FIGS. 2 and 3) where the injection ports 34 are not exposed.

The cover 50 has an exterior surface 51 that is a part of the exterior of the recording device 12 and is flush with the front surface of the case 15 when the cover 50 is positioned in the closed position. Blocking members 52 that make contact with and block the injection ports 34 are mounted to a surface of the cover 50 that faces the injection ports 34 when the cover 50 is in the closed position. That is, the surface of the cover 50 that faces the injection ports 34 in FIG. 3 is a mounting surface 53 on which the blocking members 52 are mounted. The blocking member 52 is mounted on a protrusion 54 that protrudes downward from the mounting surface 53. That is, the blocking member 52 is disposed between the cover 50 and the injection port 34 in the state the cover 50 is positioned in the closed position.

Figure 4:
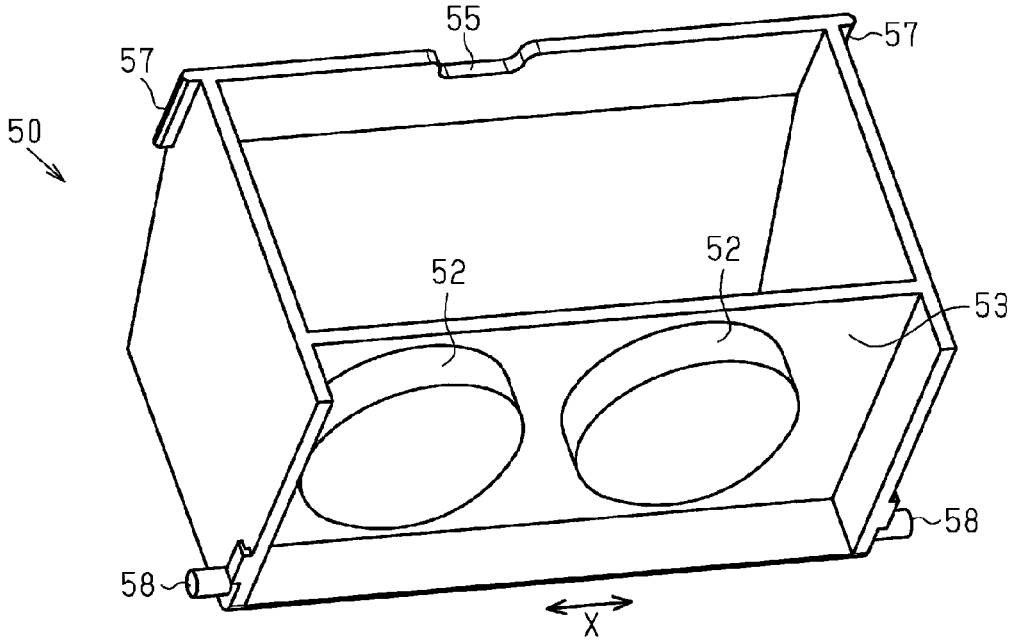
FIG. 4 is a perspective view of a cover.
Figure 5:
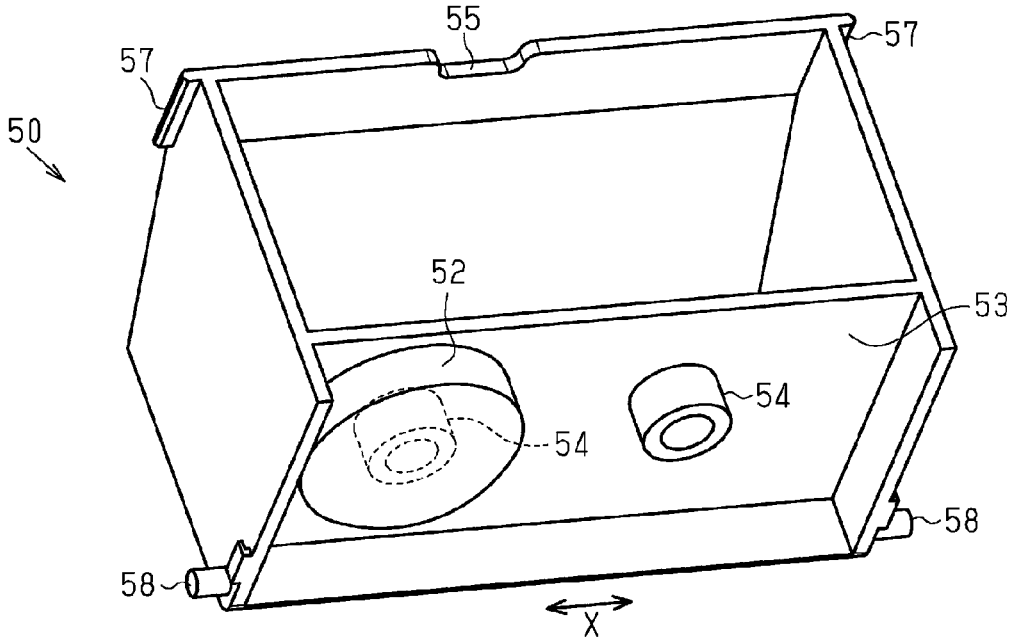
FIG. 5 is a perspective view of the cover provided with a plurality of blocking members from which a part of the blocking members is removed.

As shown in FIGS. 2, 4, and 5, a back surface of the box-shaped cover 50 opposite to the exterior surface 51 is open. A plurality of blocking members 52 that are mounted on the mounting surface 53 of the cover 50 may be provided to correspond to the number of liquid containers 30 accommodated in the case 15 (in this embodiment, two blocking members 52 are provided). In other words, a plurality of blocking members 52 corresponding to the number of the injection ports 34 provided for the liquid containers 30 is provided to the cover 50, and one blocking member 52 blocks each corresponding injection port 34. A plurality of protrusions 54 that protrude from the mounting surface 53 may be provided to correspond to the plurality of blocking members 52 (in this embodiment, two protrusions 54 are provided). The protrusion 54 has a cylindrical shape.

The blocking member 52 that is mounted on each corresponding protrusion 54 has a substantially hemispherical dome shape and is composed of an elastic member (for example, an elastomer such as a rubber) that can be elastically deformed (see FIG. 3). The blocking members 52 are detachably mounted on the protrusions 54.

A finger hook portion 55 for a user to place a finger on the portion is formed as a cutout on the surface opposite to the mounting surface 53 on which the blocking members 52 are mounted in the cover 50. In other words, the surface on which the finger hook portion 55 is formed in the cover 50 serves as a finger hook formed surface 56, and the finger hook portion 55 is formed at a central portion in the scanning X direction and close to the opening of the cover 50 on the finger hook formed surface 56. The finger hook formed surface 56 has an inclined surface that is inclined from the finger hook portion 55 toward the exterior surface 51.

As shown in FIGS. 4 and 5, in the scanning X directions, engaging portions 57 that protrude from the cover 50 toward one side and the other side respectively in the scanning X directions are formed at both ends of the cover 50 that has the finger hook portion 55 between the ends. The engaging portions 57 protrude, on both side surfaces of the cover 50 that has the finger hook formed surface 56 therebetween in the scanning X direction, from the positions opposite to the exterior surface 51 of the cover 50 and close to the finger hook formed surface 56.

In addition, on both side surfaces of the cover 50, a cylindrical shaft 58 that extends in the scanning X direction is provided at a diagonal position of the engaging portions 57, that is, at a position close to the exterior surface 51 and close to the mounting surface 53 of the cover 50.

Figure 6:
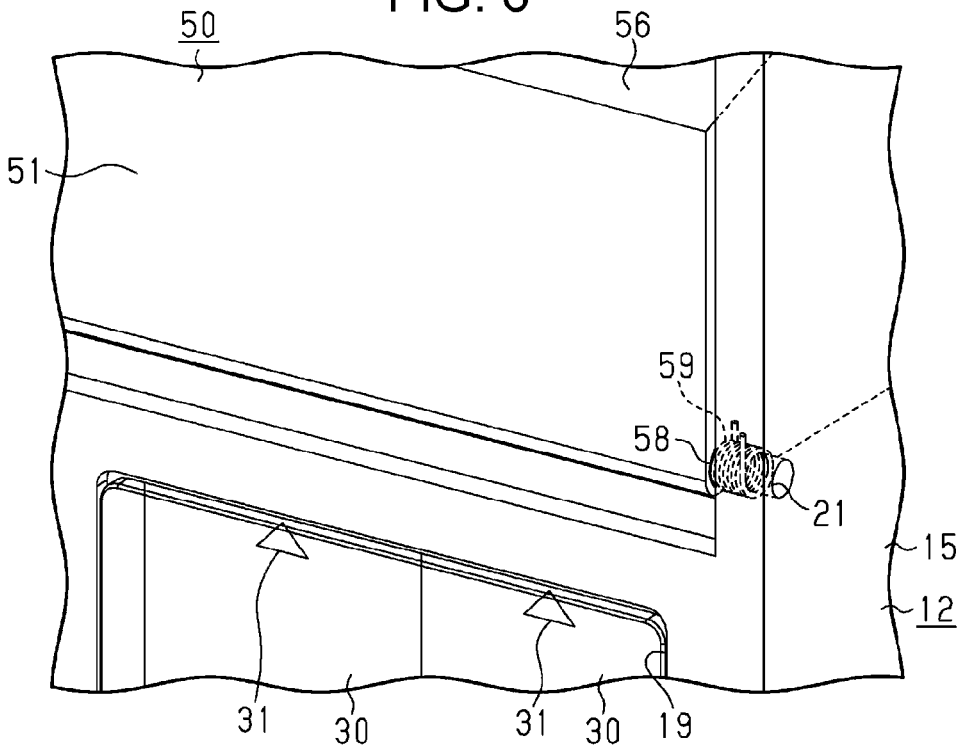
FIG. 6 is a partial enlarged view of a shaft of the cover in FIG. 2.

As shown in FIGS. 2 and 6, a circular through hole, which serves as a bearing 21 for the shaft 58, is formed in the case 15 at a position corresponding to the shaft 58 in the cover 50, that is, at a position close to the front surface and an end portion (right end in FIG. 2) of the recording device 12. The bearing 21 rotatably supports the shaft 58 such that the cover 50 can be rotatably supported about the shaft 58 with respect to the case 15. In other words, the position of the cover 50 is changed from the closed position to the open position by rotating the cover 50 toward the front side of the multifunction peripheral 11 (see FIG. 9 and FIG. 10). A spiral spring 59 is provided around the shaft 58 of the cover 50. The cover 50 is always urged by the spiral spring 59 in the direction from the open position toward the closed position.

Figure 7:
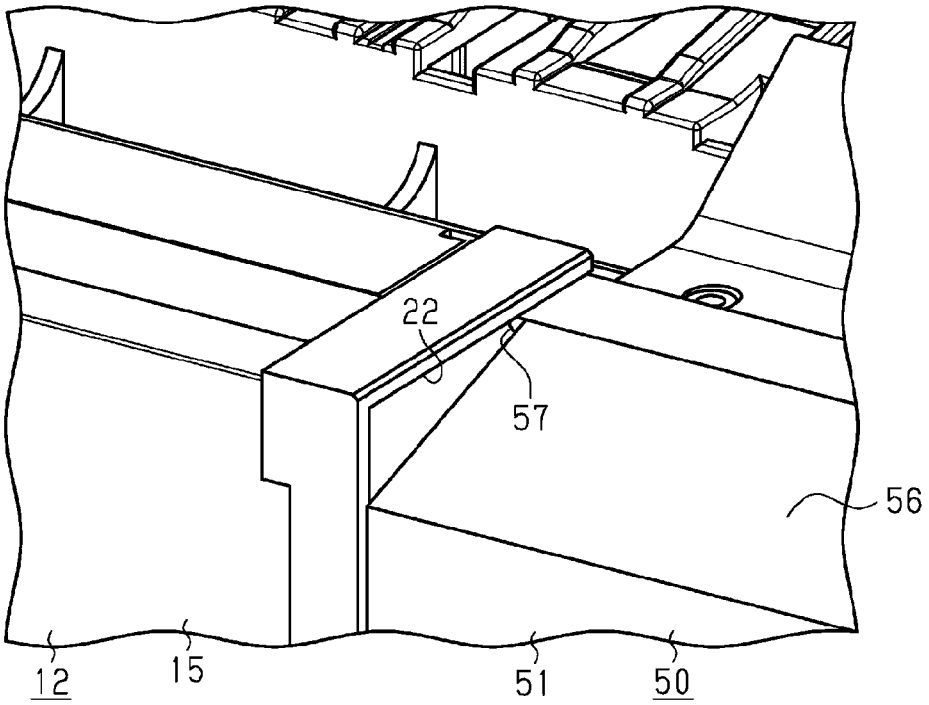
FIG. 7 is a partial enlarged view of an engagement portion of the cover in FIG. 2.

As shown in FIGS. 2 and 7, a portion to be engaged 22 is formed such that the portion 22 extends from the case 15 toward the cover 50 at a position corresponding to the engaging portion 57 in the cover 50, that is, at a position close to the front surface and an end portion (right end in FIG. 2) of the recording device 12. The portion to be engaged 22 engages with the engaging portion 57 provided to the cover 50 in the vertical Z direction when the cover 50 is at the closed position. In other words, when the engaging portion 57 engages the portion to be engaged 22, the positional change of the cover 50 that is in the closed position toward the open position is restricted.

Figure 8:
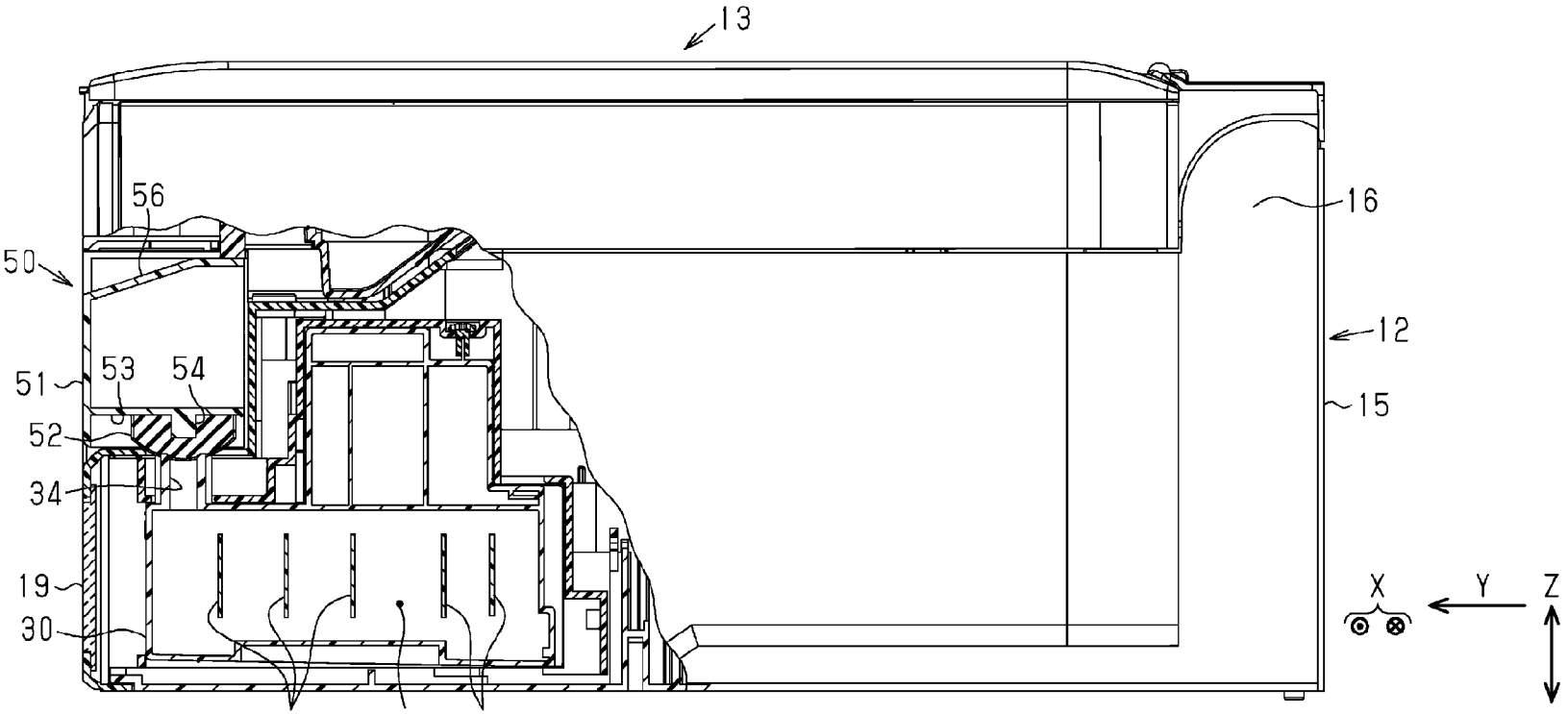
FIG. 8 is a partial cutaway side view of the multifunction peripheral in which the reading device is positioned at a closed position.

Now, the operation of the multifunction peripheral 11 that has the above-described structure, specifically, the operation of the cover 50 that covers the injection ports 34 of the liquid containers 30 provided in the recording device 12 will be described. As shown in FIG. 8, the reading device 13 is configured such that the reading device 13 can be rotated with respect to the recording device 12 with the hinge section 16 to provide access to the inside of the case 15 for users, for example, to clear a paper jam or to perform maintenance in the recording device 12. Consequently, if it is not necessary to access the inside of the recording device 12, the reading device 13 is positioned at the closed position. The reading device 13 at the closed position comes into contact with the finger hook formed surface 56 of the cover 50, which is positioned at the closed position to cover the injection ports 34 of the liquid containers 30, from above and presses the cover 50 downward in the vertical Z direction. In conjunction with the downward pressing of the cover 50, the blocking members 52 mounted on the mounting surface 53 of the cover 50 are also pressed downward. That is, the reading device 13 that is positioned at the closed position presses, through the cover 50, the blocking members 52 provided on the cover 50 with respect to the injection ports 34.

The blocking members 52, which are composed of an elastic member that can be elastically deformed, are pressed against the injection ports 34 and come in close contact with the injection ports 34 to block the injection ports 34 with the increased sealing capability against the injection ports 34. As shown in FIG. 6, the cover 50 is urged to press the blocking members 52 toward the injection ports 34 with the spiral spring 59 provided around the shaft 58, and thereby the sealing capability of the blocking members 52 against the injection ports 34 can be further increased. Moreover, as shown in FIG. 7, in the cover 50 that is positioned at the closed position, the engaging portion 57 engages with the portion to be engaged 22. Consequently, when the reading device 13 is positioned at the open position, the risk of unexpected change of the position of the cover 50 from its closed position to open position due to an impact from the outside can be reduced. That is, the blocked state of the injection ports 34 by the blocking members 52 can be maintained. The blocking of the injection ports 34 by the blocking members 52 reduces drying of the inks stored within the liquid storage chambers 33 in the liquid containers 30, leakage of the inks from the injection ports 34, mixing of dust into the liquid storage chambers 33, and the like.

As shown in FIG. 3, the reading device 13 that is positioned at the closed position is moved to the open position to expose the inside of the case 15 if it is necessary to access the inside of the case 15, for example, to clear a paper jam or to perform maintenance of the recording device 12. Similarly, the reading device 13 is moved to the open position to inject an ink into the liquid container 30.

Figure 9:
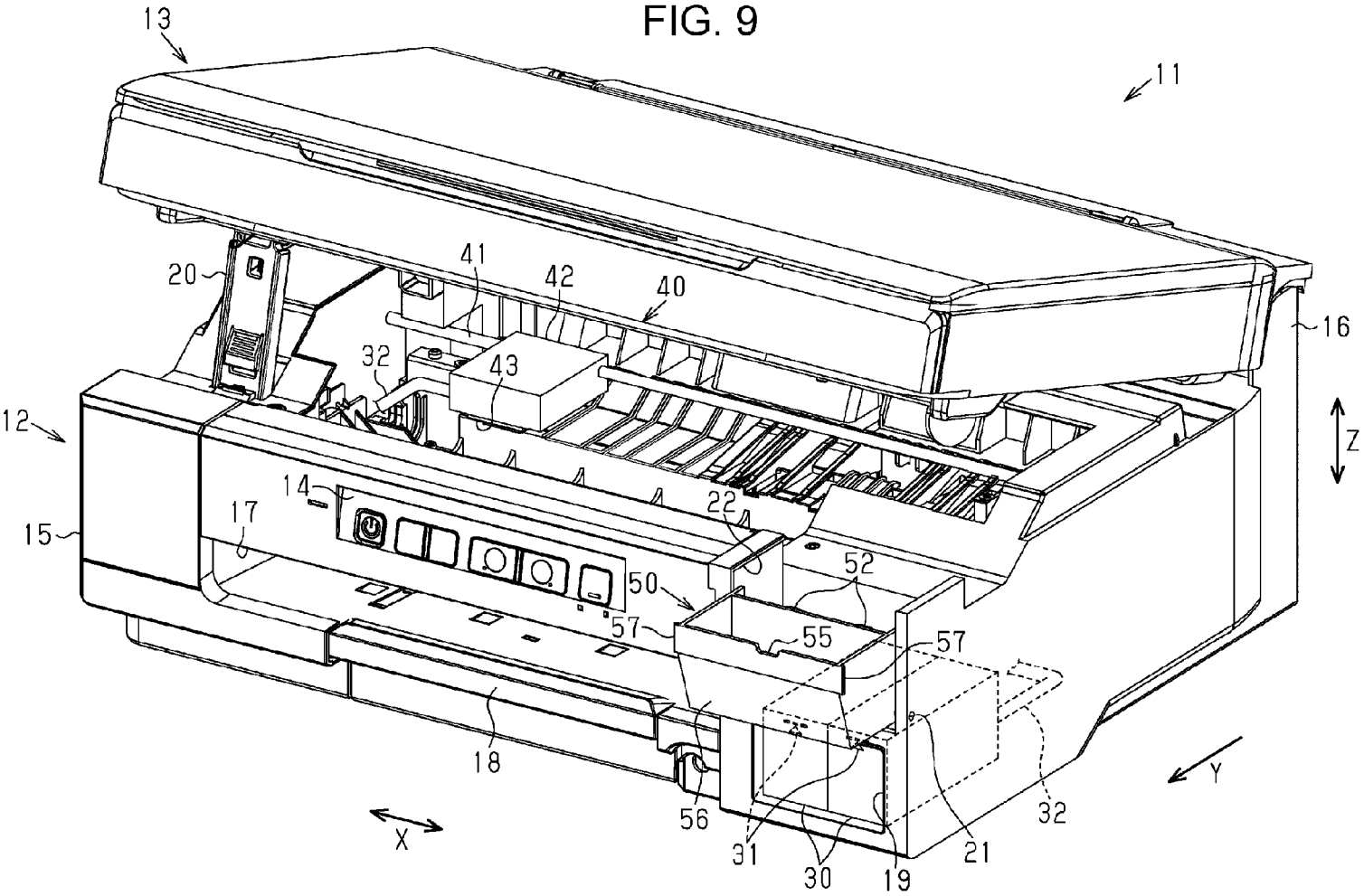
FIG. 9 is a perspective view of the multifunction peripheral in which the cover is at an open position while the reading device is at the open position.
Figure 10:
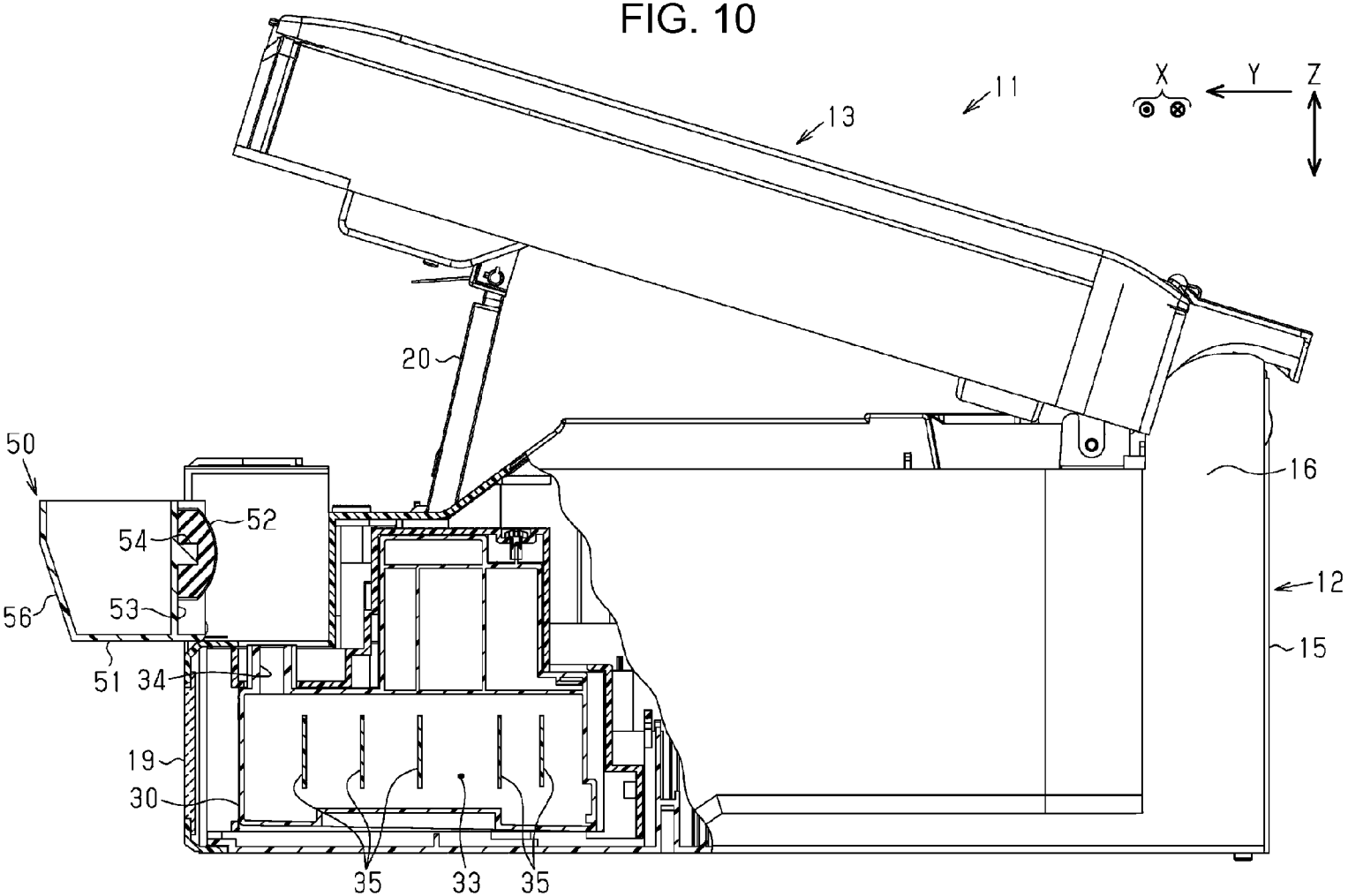
FIG. 10 is a partial cutaway side view of the multifunction peripheral in which the cover is at the open position while the reading device is at the open position.

As shown in FIG. 9 and FIG. 10, to inject an ink into the liquid storage chamber 33 of the liquid container 30, the reading device 13 is positioned at the open position and the cover 50 that has been positioned at the closed position is moved to the open position. To move the cover 50 to the open position, a user places a finger on the finger hook portion 55 and pulls the finger hook portion 55 toward the front side of the recording device 12 to rotate the cover 50 about the shaft 58 (bearing 21) to expose the injection ports 34 of the liquid containers 30. When the cover 50 is at the closed position, the engaging portion 57 engages with the portion to be engaged 22, and if the cover 50 is pulled toward the front side of the recording device 12 with a predetermined force or more, the engaging portion 57 runs on the portion to be engaged 22 and thereby the engaging state between the engaging portion 57 and the portion to be engaged 22 is released.

In response to the movement of the cover 50 to the open position, the blocking members 52 that have been in contact with the injection ports 34 are separated from the injection ports 34 and the injection ports 34 are opened. That is, by the only single operation of opening the cover 50, both the cover 50 that covers the injection ports 34 of the liquid containers 30 and the blocking members 52 that block the injection ports 34 are separated from the injection ports 34 and the injection ports 34 are opened, and thereby the inks can be injected into the liquid storage chambers 33.

When the ink injection into the liquid containers 30 is completed, it is preferable to block the injection ports 34 with the blocking members 52 and cover the blocked injection ports 34 with the cover 50 to reduce drying of the inks and mixing of airborne dust into the inks in the liquid storage chambers 33 via the injection ports 34. The blocking members 52 that can block the injection ports 34 are mounted on the cover 50, and consequently, if a user tries to make the blocking members 52 come into contact with the injection ports 34 to block the injection ports 34, the cover 50 is moved from the open position to the closed position in conjunction with the movement. That is, by the only single operation of closing the cover 50, the cover 50 covers the injection ports 34 and the blocking members 52 come into contact with the injection ports 34, and thereby the injection ports 34 are blocked. Consequently, in the recording device 12 provided in the multifunction peripheral 11, the injection ports 34 can be opened or blocked in conjunction with the opening or closing operation of the cover 50 that covers the injection ports 34 of the liquid containers 30.

According to the above-described embodiment, the following advantages can be achieved.

(1) The contact operation or the separation operation of the blocking members 52 for blocking the injection ports 34 are performed to the injection ports 34 in conjunction with the opening or closing operations of the cover 50 that covers the injection ports 34 of the liquid containers 30. That is, the blocking members 52 can be separated from the injection ports 34 when a user opens the cover 50, and consequently, the user is able to inject the inks into the liquid storage chambers 33 by only opening the cover 50. Consequently, liquids can be injected into the liquid containers 30 without being laborious while the blocking members 52 for blocking the injection ports 34 provided on the liquid containers 30 that store the liquids and the cover 50 that covers the injection port 34 are provided.

(2) The blocking members 52 that are mounted on the mounting surface 53 of the cover 50 are detachable, and the blocking member 52 can be replaced as needed, for example, if the blocking member 52 has deteriorated.

(3) The blocking members 52 are capable of coming into contact in an elastically deformable manner with the injection ports 34 of the liquid containers 30, and thereby the sealing capability of the blocking members 52 can be increased and the injection ports 34 can be appropriately blocked.

(4) The plurality of blocking members 52 that block the plurality of injection ports 34 respectively can be separated from the injection ports 34 in a single operation by opening the cover 50, and thereby time and labor for injecting liquids into the plurality of liquid containers 30 can be reduced.

(5) The cover 50 can be more readily opened or closed by rotating the cover 50 about the shaft 58 compared with, for example, a structure in which a cover is opened or closed by sliding the cover.

(6) The risk of the cover 50 readily opening in response to an impact or vibrations can be reduced by the engagement of the engaging portion 57 with the portion to be engaged 22.

(7) The amounts of inks remaining in the liquid storage chambers 33 can be checked through the viewing section 19 and the inks can be injected into the liquid containers 30 at an appropriate time.

(8) The sealing capability of the blocking members 52 to the injection ports 34 can be further increased by the spiral spring 59.

(9) The upper limit of the ink the liquid storage chamber 33 can contain can be checked with the upper limit value 31 marked on the liquid container 30. Consequently, the ink can be prevented from overflowing from the injection port 34 due to excessive ink injection when the ink is injected into the liquid storage chamber 33 via the injection port 34.

(10) The liquid container 30 is disposed on the front surface side of the case 15 and at an end portion (in FIG. 1, the right end) in the scanning X direction in the rectangular parallelepiped case 15. Consequently, the space in the case 15 can be efficiently used and the ink can be readily injected into the liquid container 30.

The above-described embodiment may be modified as described below.

Figure 11:
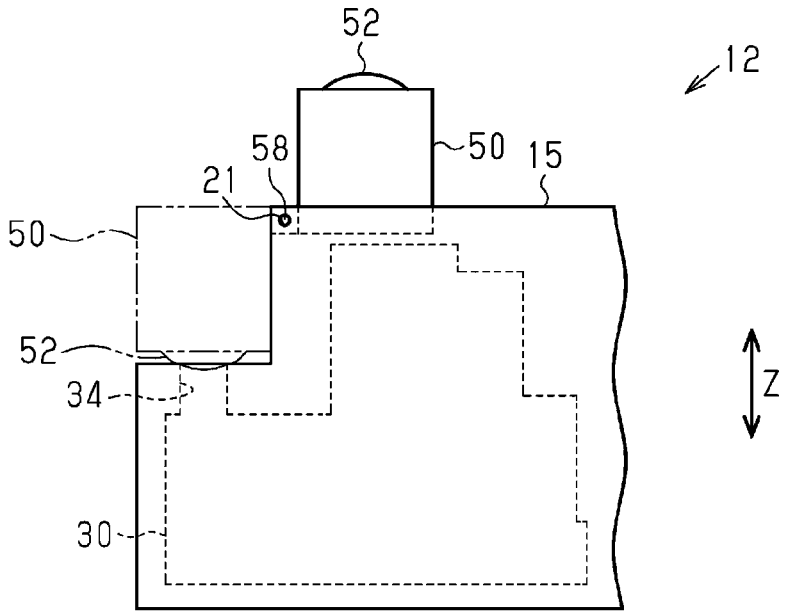
FIG. 11 shows a modification of the cover.

As shown in FIG. 11, in the above-described embodiment, the cover 50 may be opened or closed by rotating the cover 50 from the closed position where the blocking member 52 comes into contact with the injection port 34 toward the back surface of the recording device 12 about the shaft 58.

Figure 12:
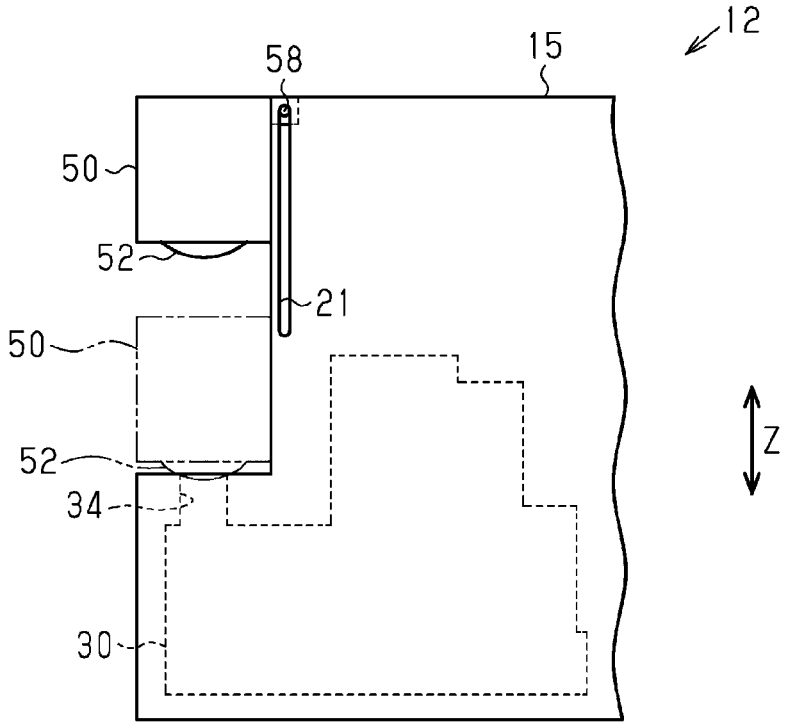
FIG. 12 shows a modification of the cover.

As shown in FIG. 12, in the above-described embodiment, the cover 50 may be slid upward and downward along the bearing 21 that is long in the vertical Z direction in the case 15 such that the position of the cover 50 can be changed between the open position and the closed position.

Figure 13:
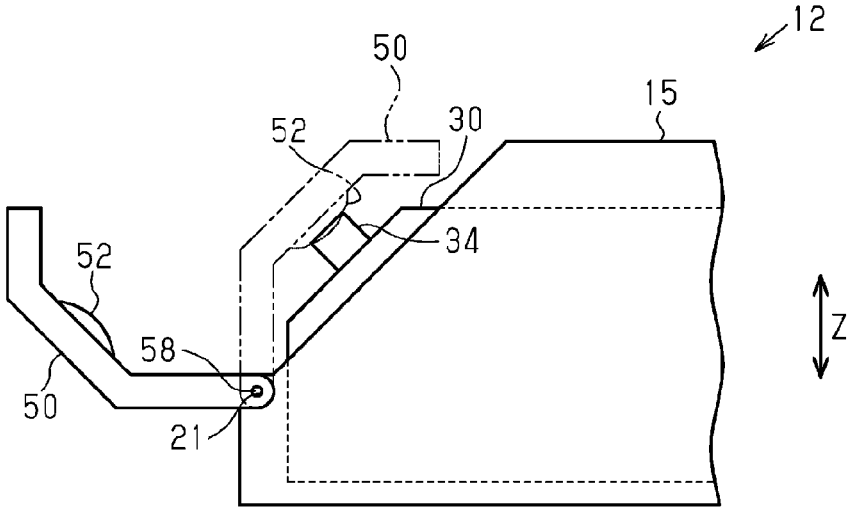
FIG. 13 shows a modification of the cover.

As shown in FIG. 13, in the above-described embodiment, the injection port 34 provided to the liquid container 30 may be extended in a diagonally forward direction with respect to the recording device 12. The cover 50 may have a plate-like shape, and is not limited to the cover 50 that has a specific shape.

Figure 14:
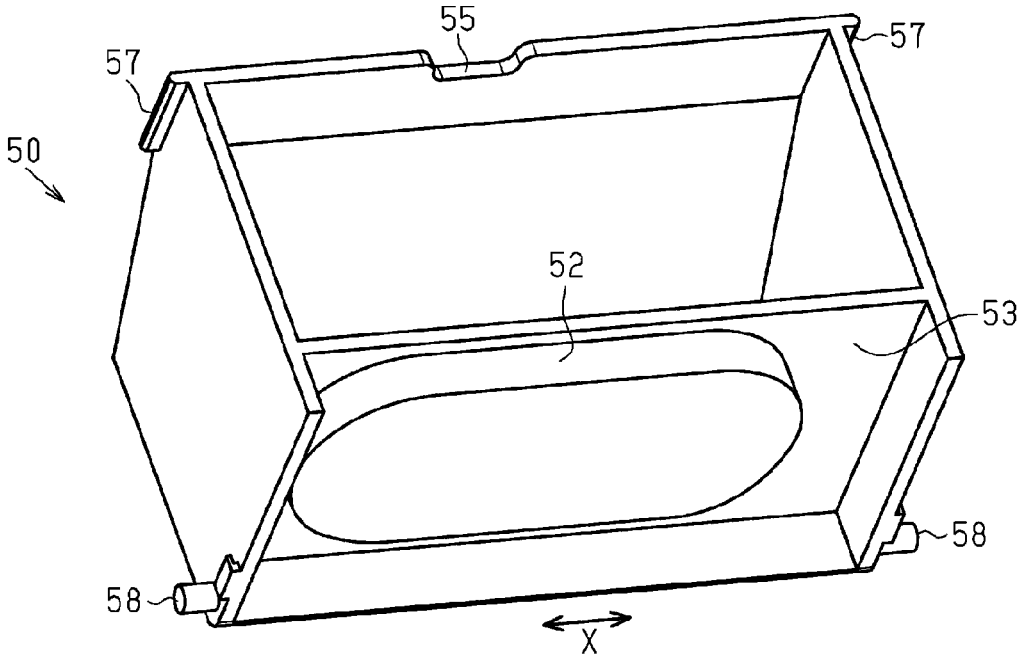
FIG. 14 shows a modification of the blocking member.

As shown in FIG. 14, in the above-described embodiment, the blocking members 52 that are mounted on the cover 50 may be one blocking member 52 that can block a plurality of injection ports 34. For example, one blocking member 52 that is long in the scanning X direction may be provided to block the plurality of injection ports 34. With this structure, one blocking member 52 that blocks the plurality of injection ports 34 together can be simultaneously separated from all injection ports by opening the cover 50, and thereby time and labor for injecting inks into the plurality of liquid containers 30 can be reduced.

Figure 15:
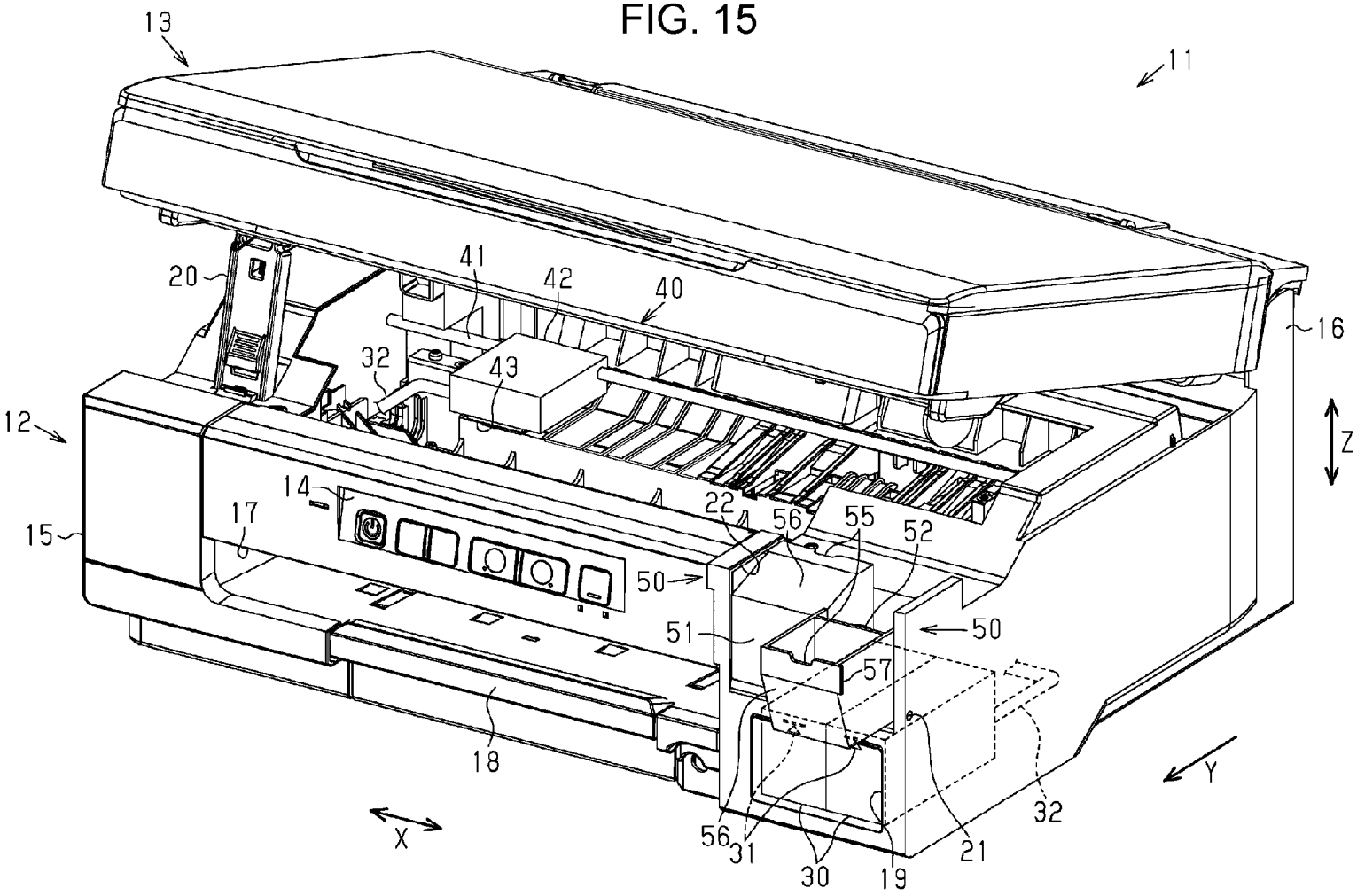
FIG. 15 shows a modification of the cover.

As shown in FIG. 15, in the above-described embodiment, a plurality of covers 50 corresponding to the number of liquid containers 30 may be provided. Since one blocking member 52 can be mounted to one cover 50, the injection port 34 of the liquid container 30 that requires ink injection can be exclusively opened and thereby, for example, drying of the inks and mixing of dust into the inks stored in the other liquid containers 30 that do not require ink injection can be reduced.

Figure 16:
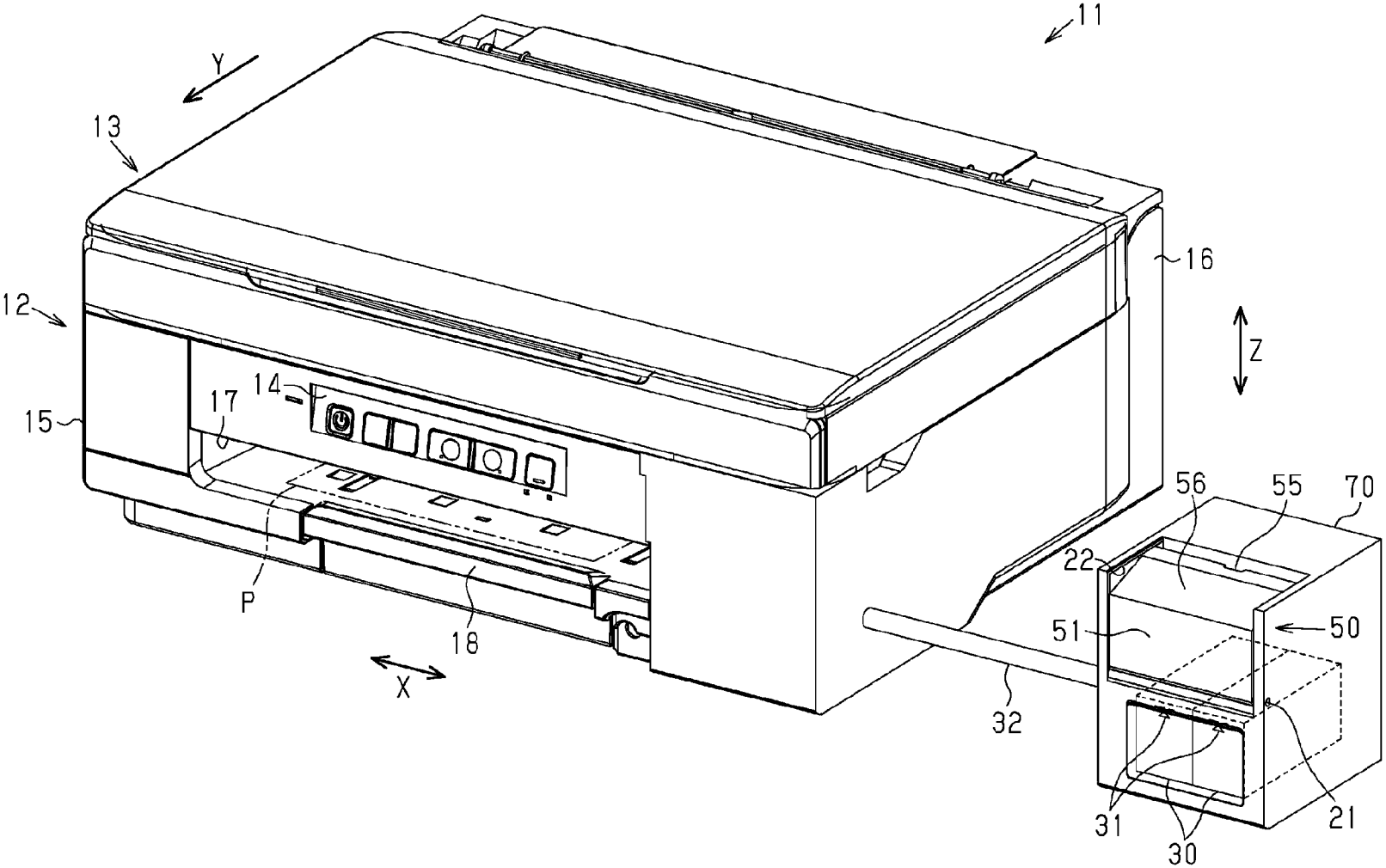
FIG. 16 shows a modification of the multifunction peripheral.

As shown in FIG. 16, in the above-described embodiment, the liquid container 30 may be accommodated in a liquid container holder 70 provided separately from the recording device 12. The liquid container 30 accommodated in the liquid container holder 70 is connected to the supply tube 32 that extends through the recording device 12.

In the above-described embodiment, the blocking members 52 may be plug members that are inserted into the injection ports 34 to block the injection ports 34 respectively.

In the above-described embodiment, the position of the cover 50 may be changed between the open position and the closed position by detachably providing the cover 50 with respect to the case 15.

In the above-described embodiment, the cover 50 may be rotatably provided by providing the shaft 58 in the case 15 and providing the bearing 21 in the cover 50.

In the above-described embodiment, the number of the liquid containers 30 provided in the recording device 12 is not limited to two, and alternatively, one or three or more liquid containers 30 may be provided. Furthermore, the number of the blocking members 52 provided on the cover 50 is not limited to two, and alternatively, one or three or more blocking members 52 may be provided.

In the above-described embodiment, the material used for the liquid containers 30 is not limited to the resin. The liquid container 30 may be made of a material that enables users at least to view the amounts of inks stored in the liquid storage chambers 33 in the liquid containers 30 so that the users can check the amounts of inks through the viewing section 19.

In the above-described embodiment, the opening and closing member that is opened or closed such that the inside of the case 15 can be exposed is not limited to the reading device 13 that can read an image, and alternatively, a simple cover member may be used.

In the above-described embodiment, a part of the liquid containers 30 may be accommodated in the case 15.

In the above-described embodiment, the recording section 40 is not limited to the serial head type in which the recording section 40 moves in the scanning X directions with respect to the paper P, and alternatively, a line head type in which the recording section 40 that is long in the scanning X directions is provided may be employed.

In the above-described embodiment, the recording device 12 may be a fluid ejection apparatus that ejects or discharges a fluid (for example, liquids, liquid materials containing particles of a functional material dispersed or mixed in a liquid, and fluid materials such as gels) other than inks for recording. For example, the recording device 12 may be a liquid material ejecting apparatus that ejects a liquid material containing a dispersed or dissolved material such as an electrode material or a color material (pixel material) used for manufacturing liquid crystal displays, electroluminescence (EL) displays, or field emission displays (FEDs) for recording. Alternatively, the recording device 12 may be a fluid ejecting apparatus that ejects a fluid material such as a gel (for example, a physical gel). The present invention may be applied to any one of the fluid ejecting apparatuses. In this specification, "fluid" implies a concept that does not include fluids that consist of only gas, and the fluid includes, for example, liquids (including inorganic solvents, organic solvents, solutions, liquid resins, liquid metals (metallic melts), and the like), liquid materials, and fluid materials.

The entire disclosure of Japanese Patent Application No. 2015-166987, filed Aug. 26, 2015 is expressly incorporated by reference herein.

What is claimed is:

1. A recording apparatus comprising:

a recording head configured to discharge a liquid onto a medium for recording;

a casing accommodating at least the recording head;

an opening and closing member openable and closable between an open position and a closed position;

at least one liquid container having a liquid storage chamber for storing the liquid to be supplied to the recording head and an injection port enabling the liquid to be injected from the outside to the inside of the liquid storage chamber;

at least one blocking member configured to block the injection port by coming into contact with the injection port; and a cover provided such that the cover can be opened or closed between an open position where the injection port is exposed and a closed position where the injection port is not exposed, wherein the number of the liquid containers is two or more, and the number of the blocking members corresponds to the number of the injection ports in the liquid containers, and the blocking members are mounted on the cover.

2. The recording apparatus according to claim 1, wherein the blocking members are detachably mounted on the cover.

3. The recording apparatus according to claim 1, wherein the blocking member is larger than the injection port, and is composed of an elastically deformable elastic member.

4. The recording apparatus according to claim 1, wherein the casing further accommodates at least a part of the liquid containers, and the cover is rotatably provided with respect to the casing.

5. The recording apparatus according to claim 4, wherein an engaging portion is provided in one of the cover and the casing, and a portion to be engaged, which can be engaged with the engaging portion, is provided in the other one, and the engaging portion engages with the portion to be engaged when the cover is positioned in the closed position.

6. The recording apparatus according to claim 4, wherein the casing has a discharge port, from which the medium on which recording has been performed with the recording head in the casing is to be discharged to the outside of the casing, and the liquid containers are disposed at locations corresponding to a side at which the discharge port is provided in the casing and a corner in the casing.

7. The recording apparatus according to claim 4, wherein the casing includes an operation section to be used to operate the recording apparatus, and the liquid containers are disposed at locations corresponding to the side at which the operation section is provided in the casing and a corner in the casing.

8. The recording apparatus according to claim 6, wherein the casing includes a viewing section through which the amounts of the liquids stored in the liquid storage chambers in the liquid containers can be viewed.

9. A recording apparatus comprising:

a recording head configured to discharge a liquid onto a medium for recording;

a casing accommodating at least the recording head;

an opening and closing member openable and closable between an open position and a closed position;

at least one liquid container having a liquid storage chamber for storing the liquid to be supplied to the recording head and an injection port enabling the liquid to be injected from the outside to the inside of the liquid storage chamber;

a blocking member configured to block the injection port by coming into contact with the injection port; and a cover provided such that the cover can be opened or closed between an open position where the injection port is exposed and a closed position where the injection port is not exposed, wherein the number of the liquid containers is two or more; and the blocking member is mounted on the cover, and configured to block the plurality of injection ports in the plurality of liquid containers.

10. The recording apparatus according to claim 9, wherein the blocking member is larger than the injection port, and is composed of an elastically deformable elastic member.

11. The recording apparatus according to claim 9, wherein the casing further accommodates at least a part of the liquid containers, and the cover is rotatably provided with respect to the casing.

12. The recording apparatus according to claim 11, wherein an engaging portion is provided in one of the cover and the casing, and a portion to be engaged, which can be engaged with the engaging portion, is provided in the other one, and the engaging portion engages with the portion to be engaged when the cover is positioned in the closed position.

13. The recording apparatus according to claim 11, wherein the casing has a discharge port, from which the medium on which recording has been performed with the recording head in the casing is to be discharged to the outside of the casing, and the liquid containers are disposed at locations corresponding to a side at which the discharge port is provided in the casing and a corner in the casing.

14. The recording apparatus according to claim 11, wherein the casing includes an operation section to be used to operate the recording apparatus, and the liquid containers are disposed at locations corresponding to the side at which the operation section is provided in the casing and a corner in the casing.

15. The recording apparatus according to claim 11, wherein the casing includes a viewing section through which the amounts of the liquids stored in the liquid storage chambers in the liquid containers can be viewed.

* * * * *